US005325809A

United States Patent [19]

Mulle, Jr.

[11] Patent Number: 5,325,809

[45] Date of Patent: Jul. 5, 1994

[54] HAIR DRYER WITH ALARM NOTIFYING USER OF CLOGGED FILTER

[75] Inventor: Theodore B. Mulle, Jr., Ridgefield, Conn.

[73] Assignee: Conair Corporation, Stamford, Conn.

[21] Appl. No.: 52,582

[22] Filed: Apr. 26, 1993

[51] Int. Cl.[5] ..... G08B 21/00

[52] U.S. Cl. ..... 116/70; 116/112; 116/DIG. 25

[58] Field of Search ..... 34/97; 116/70, 112, 116/DIG 25, 67 R, 137 R; 392/385

[56] References Cited

U.S. PATENT DOCUMENTS

| | | | |
|---|---|---|---|
| 2,753,831 | 7/1956 | Davies | 116/112 |
| 3,699,749 | 10/1972 | Nowicki | 116/137 A |
| 4,215,646 | 8/1980 | Williams | 116/70 |
| 4,254,324 | 3/1981 | Vrtaric | 392/385 |
| 4,321,070 | 3/1982 | Bede | 116/70 X |
| 4,634,839 | 1/1987 | Gilbertson | 392/385 X |
| 4,896,021 | 1/1990 | Poweleit et al. | 392/385 X |

*Primary Examiner*—William A. Cuchlinski, Jr.
*Assistant Examiner*—W. Morris Worth
*Attorney, Agent, or Firm*—Haynes N. Johnson

[57] ABSTRACT

A warning system for a hair dryer to warn the user when the air inlet of the dryer has become clogged with hair or other particles, the dryer including an air filter in the inlet, an air-actuated whistle having an air inlet end and an air outlet end, the whistle being mounted in the air inlet with the air inlet end outside the filter and the air outlet end inside the filter. Air will pass through the whistle when the inlet has become clogged, causing it to blow, and thereby warning the user that the inlet has become clogged. This occurs when the air pressure differential between the two sides of the filter reaches a predetermined level.

4 Claims, 1 Drawing Sheet

Fig. 1.
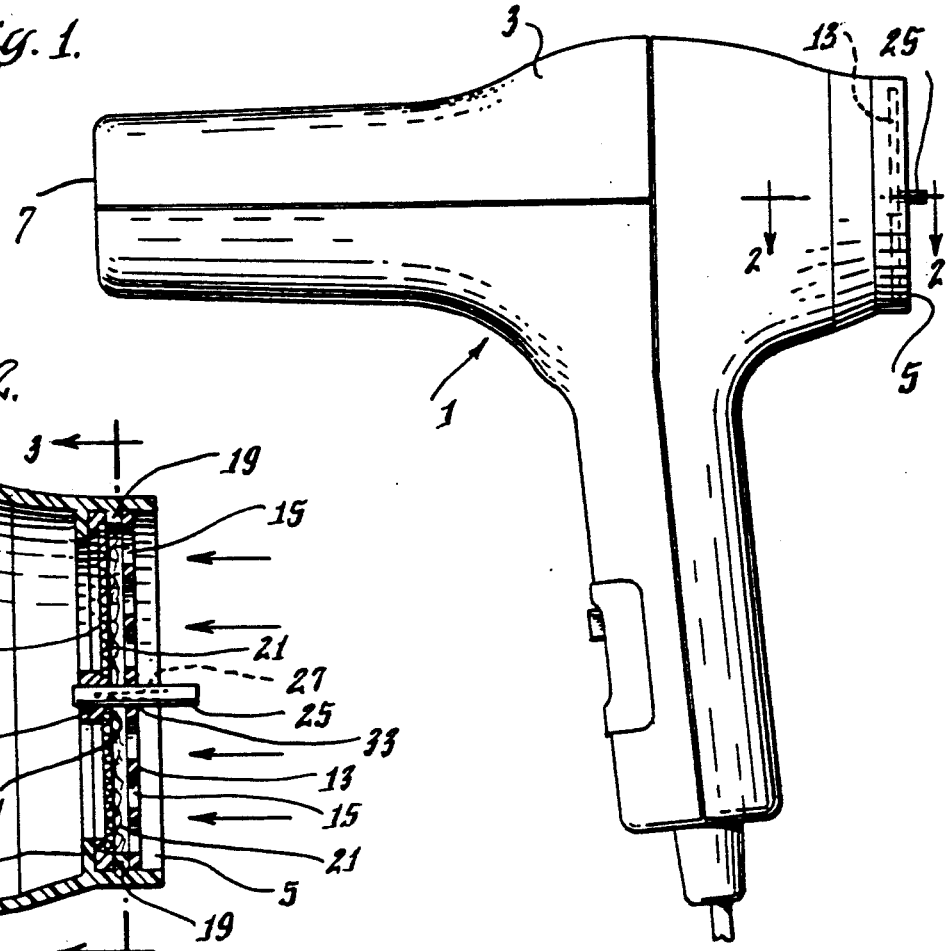
Fig. 2.
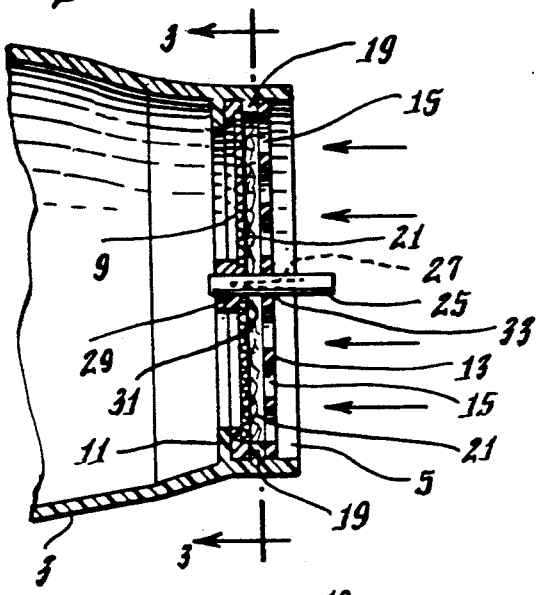
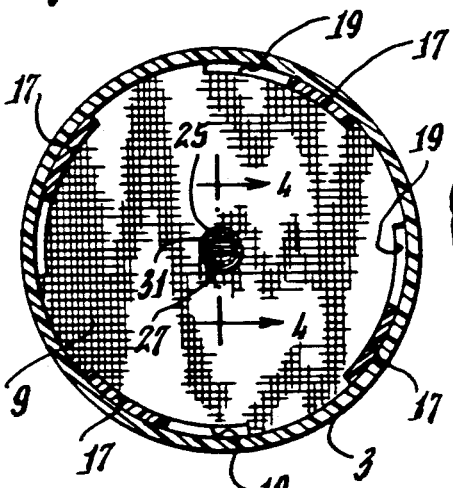
Fig. 3.
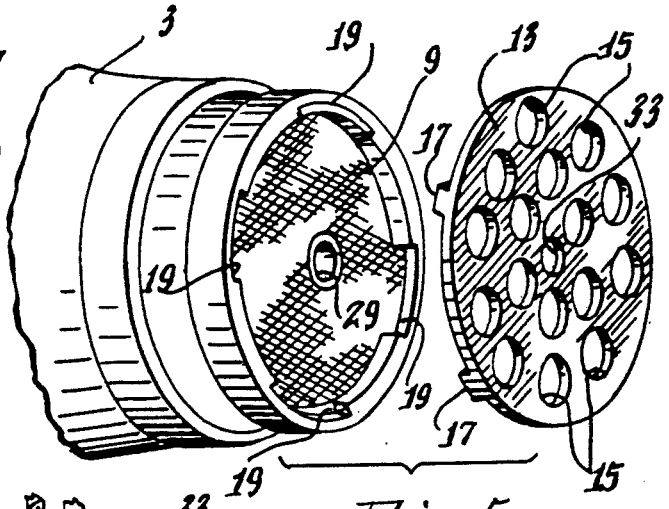
Fig. 5.
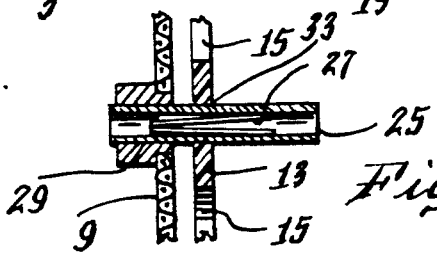
Fig. 4.

HAIR DRYER WITH ALARM NOTIFYING USER OF CLOGGED FILTER

FIELD OF THE INVENTION

This invention relates to hand-held hair dryers, and, in particular, to hair dryers which contain an alarm which notifies the user that the air filter in the dryer has become clogged with hair.

BACKGROUND OF THE INVENTION

Hair dryers include air inlets drawing air in for use in drying; and there is a tendency for the air inlets to suck in bits of hair and other particles. To avoid it reaching the fan and the heating element, and to avoid the user's hair getting sucked into the fan, a filter is usually placed in the air inlet. This filter can become covered with bits of hair or other particles and, so, block the flow of incoming air. This can cause dangerous overheating of the heating element in the dryer and of the remaining air flowing out of the unit.

My invention gives a signal to the user whenever this clogging occurs.

BRIEF SUMMARY OF THE INVENTION

An air-operated whistle or other warning device is placed in the air inlet, passing through the filter. During normal operation of the dryer, the air enters the dryer through the air inlet, but does not pass through the whistle. This is because air flows freely through the filter and there is insufficient air pressure drop between the two sides of the filter.

When, however, the filter becomes clogged, less air flows through it and the dryer fan will create an area of substantially reduced pressure just inside the filter. As a result, there is an air pressure differential between the two sides of the filter. When this differential in air pressure becomes great enough, air will flow through the whistle, causing it to sound a warning to the user. The filter can then be cleaned, restoring the unit to normal, with the differential air pressure gone.

DESCRIPTION OF THE DRAWINGS

FIG. 1 is a side elevation of a hair dryer of the type which can use my invention.

FIG. 2 is a section taken on line 2—2 of FIG. 1.

FIG. 3 is a section taken on line 3—3 of FIG. 2.

FIG. 4 is a section taken on line 4—4 of FIG. 3.

FIG. 5 is an exploded perspective view of the air inlet of the hair dryer, showing the filter.

DETAILED DESCRIPTION OF THE INVENTION

A hair dryer 1 of one usual type has a housing 3 with an air inlet 5 and an air outlet 7. A fan is inside the housing to draw air into the inlet and force it out the outlet; and a heating element inside the housing heats the air as it passes through.

An inlet filter 9 is positioned in the air inlet 5 and held in place by supporting spider 11. An inlet filter guard 13 is positioned outside the air filter and has openings 15 for air passage. Guard 13 is removably held in position by bayonet mount 17 on guard 13 which interlocks with corresponding bayonet mount 19 on the housing 3. Hair 21 and other particles are caught by the filter and held between the filter and the guard. Periodically guard 13 can be lifted out and collected hair 21 removed from the surface of the filter.

If the collected hair is not removed, it blocks all or part of the air flow into the inlet. This, besides being inconvenient, can also be dangerous. Blocked air flow means that the dryer can overheat and that the air that does flow through will be overheated. Since the fan continues to operate, however, the blockage will cause a pressure differential between the inside and the outside of the filter, with the inside having the lower pressure.

I take advantage of this pressure differential by positioning a whistle 25, with its reed 27, in the air inlet. It is mounted at opening 29 in the spider, passes through opening 31 in filter 9, and through opening 33 in guard 13. The whistle is oriented such that air flowing in the direction of the inlet air will cause it to blow. It will not blow, however, without a sufficient pressure differential between its two ends. Thus, when the filter is not clogged, the pressure differential is low and insufficient to cause the whistle to blow. When, however, the filter gets clogged to an extent that is predetermined, the pressure differential becomes great enough to cause the whistle to blow. The user is accordingly warned that the filter needs cleaning. Once the filter has been cleaned, the whistle will cease to blow.

Other pressure sensitive devices can be used in lieu of a whistle in the same way as the whistle.

I claim:

1. A warning system for a hair dryer to warn when the inlet of the dryer has become clogged with hair or other particles, said dryer including a housing having an air inlet and a filter in said air inlet, said system including an air-actuated whistle having an air inlet end and an air outlet end, said whistle being mounted in said filter with said air inlet end outside said housing and said air outlet end inside said housing, whereby air will pass through said whistle when said air inlet has become clogged, causing it to blow, and thereby giving a warning that said inlet has become clogged.

2. A warning system as set forth in claim 1 in which said whistle will blow when the air pressure differential between the two sides of said filter reaches a predetermined level.

3. A warning system formed as part of a hair dryer to provide a warning whenever an air inlet of said hair dryer becomes overly clogged with hair other matter, said system including a dryer housing having an air inlet, an air filter across said air inlet, and means for supporting said air filter, said air filter having an outer side and an inner side inside of said housing, an air actuated whistle mounted in said air filter having a whistle air inlet and a whistle air outlet, said whistle being mounted with said whistle air inlet adjacent said outer side of said air filter and said whistle air outlet adjacent said inner side of said air filter, whereby air will pass through said whistle when said air filter has become clogged, causing it to blow, and thereby giving a warning that said air filter has become clogged.

4. A warning system as set forth in claim 3 in which said whistle will blow when the air pressure differential between the two sides of said filter reaches a predetermined level.

* * * * *